US012643636B2

(12) United States Patent
Smenes

(10) Patent No.: US 12,643,636 B2
(45) Date of Patent: Jun. 2, 2026

(54) OFFSHORE ANCHORING METHODS AND SYSTEMS

(71) Applicant: MARINHUB AS, Farstad (NO)

(72) Inventor: Rune-Andre Smenes, Farstad (NO)

(73) Assignee: MARINHUB AS, Farstad (NO)

( * ) Notice: Subject to any disclaimer, the term of this patent is extended or adjusted under 35 U.S.C. 154(b) by 33 days.

(21) Appl. No.: 18/919,454

(22) Filed: Oct. 18, 2024

(65) Prior Publication Data

US 2025/0136250 A1 May 1, 2025

(30) Foreign Application Priority Data

Oct. 25, 2023 (NO) ..... 20231132

(51) Int. Cl.
*B63B 21/50* (2006.01)
*B63B 21/26* (2006.01)
*B63B 21/00* (2006.01)

(52) U.S. Cl.
CPC ..... *B63B 21/502* (2013.01); *B63B 21/26* (2013.01); *B63B 2021/004* (2013.01)

(58) Field of Classification Search
CPC ..... B63B 21/502; B63B 21/50; B63B 21/26; B63B 2021/004
See application file for complete search history.

(56) References Cited

U.S. PATENT DOCUMENTS 3,967,572 A * 7/1976 Lea ..... B63B 21/18 114/294
4,033,277 A 7/1977 Schaper
4,320,993 A * 3/1982 Hunter ..... E21B 41/10 405/223.1
4,352,599 A 10/1982 Goldsmith
4,451,170 A * 5/1984 Cowan ..... B63B 21/50 403/57
4,650,431 A * 3/1987 Kentosh ..... B63B 22/026 441/4
5,755,533 A * 5/1998 Snyder, Jr. ..... E02D 27/52 405/223.1

(Continued)

FOREIGN PATENT DOCUMENTS

AU 2009269833 A1 * 1/2010 ..... E21B 19/16
AU 2018353794 B2 * 3/2024 ..... B63B 21/04

(Continued)

*Primary Examiner* — Frederick L Lagman
(74) *Attorney, Agent, or Firm* — Norman B. Thot

(57) ABSTRACT

A method of temporarily anchoring a mobile offshore drilling unit (MODU) at an offshore drilling site includes laying out anchoring assemblies at a sea floor. Each anchoring assembly has a connection unit adjacent to the drilling site, an anchor line extending away therefrom, and a sea floor anchor. The MODU is brought to the drilling site. Successively, for each connection unit, a dynamic positioning system at the MODU is operated to move the MODU to a position substantially vertically above the connection unit, a drilling unit anchor line having a connection member is lowered from the MODU to engage the connection unit, and the drilling unit anchor line is connected with the respective anchoring assembly via the connection unit and the connection member. Each drilling unit anchor line is tensioned from the MODU to anchor the MODU at the drilling site via the plurality of anchoring assemblies.

18 Claims, 9 Drawing Sheets

(56) References Cited

U.S. PATENT DOCUMENTS

| | | | | | |
|---|---|---|---|---|---|
| 5,979,353 | A * | 11/1999 | Børseth | B63B 21/507 | 114/230.26 |
| 6,009,825 | A | 1/2000 | Fulton et al. | | |
| 6,685,396 | B1 * | 2/2004 | Bergeron | F16G 11/00 | 405/226 |
| 7,452,162 | B2 * | 11/2008 | Wybro | B63B 75/00 | 405/223.1 |
| 8,057,121 | B2 * | 11/2011 | Gallagher | F16B 21/04 | 403/349 |
| 8,381,383 | B2 * | 2/2013 | Smith | B63B 21/26 | 29/464 |
| 9,488,203 | B2 * | 11/2016 | Sekretta | B63B 21/50 | |
| 9,879,708 | B2 * | 1/2018 | Sekretta | F16B 21/16 | |
| 10,035,568 | B2 * | 7/2018 | Taylor | B63B 21/50 | |
| 2005/0166825 | A1 | 8/2005 | Zimmerman et al. | | |
| 2010/0098498 | A1 * | 4/2010 | Humphreys | B63B 21/50 | 405/224.4 |
| 2012/0031320 | A1 * | 2/2012 | Bauduin | B63B 22/04 | 403/374.2 |
| 2012/0067267 | A1 | 3/2012 | Ribesen et al. | | |
| 2016/0347419 | A1 | 12/2016 | Lang | | |
| 2018/0222556 | A1 | 8/2018 | Erlendsson | | |

FOREIGN PATENT DOCUMENTS

| | | | | |
|---|---|---|---|---|
| CN | 109484575 | A | 3/2019 | |
| CN | 116075463 | A * | 5/2023 | B63B 21/04 |
| EP | 0 045 653 | A1 | 2/1982 | |
| WO | WO 2011/102730 | A1 | 8/2011 | |
| WO | WO 2014/083056 | | 6/2014 | |
| WO | WO 2016/030914 | A1 | 3/2016 | |

* cited by examiner

OFFSHORE ANCHORING METHODS AND SYSTEMS

CROSS REFERENCE TO PRIOR APPLICATIONS

Priority is claimed to Norwegian Patent Application No. 20231132, filed Oct. 25, 2023. The entire disclosure of said application is incorporated by reference herein.

FIELD

The present invention relates to methods and systems for anchoring floating offshore structures, such as drilling vessels, which should be temporarily anchored at an offshore location, for example, to perform a drilling or other type of well operation.

BACKGROUND

It is common in offshore drilling operations to use mobile offshore drilling units (MODUs) to prepare new subterranean wells or to perform other operations on or in relation to wells, such as well intervention or decommissioning, installation, or removal of equipment, etc.

For such operations, a MODU may be located at a relevant site for an extended period of time, such as several weeks, months, or years. Floating MODUs, such as semi-submersible rigs or drillships, may typically be anchored at the site for this purpose via a plurality of anchoring assemblies comprising sea floor anchors and anchor lines (such as chains and/or ropes) to connect to the MODU. Anchor handling vessels are typically used to lay out the anchoring assemblies prior to arrival of the MODU, to assist in hooking up the anchoring assemblies to the MODU on arrival, to disconnect the anchoring assemblies after the MODU has performed the required operations, and to recover/retrieve the anchoring assemblies from the sea floor. This generates considerable costs and requires considerable energy (and thereby produces emissions) from the anchor handling vessels.

Publications which may be useful to understand the field of technology include US 2010/0098498 A1, which describes an anchor system for an offshore dynamically positioned drilling platform, WO 2011/102730 A1 and US 2012/0067267 A1, which describe a method for mooring a marine vessel using three or more anchor lines, U.S. Pat. No. 4,033,277, US 2005/166825 A1, WO 2014/083056 A1, CN 109484575 A, US 2016/347419 A1, WO 2016/030914 A1, and U.S. Pat. No. 6,009,825.

A need still exists for improved systems and methods for temporarily anchoring offshore vessels/MODUs in an efficient and safe manner.

SUMMARY

An aspect of the present invention is to provide improved systems and methods for temporarily anchoring offshore vessels/MODUs in an efficient and safe manner, or to at least to provide useful alternatives to the state of the art.

In an embodiment, the present invention provides a method of temporarily anchoring a mobile offshore drilling unit at an offshore drilling site. The method includes laying out a plurality of anchoring assemblies at the sea floor. Each anchoring assembly of the plurality of anchoring assemblies comprises a connection unit which is laid out adjacent to the offshore drilling site, an anchor line which extends away from the offshore drilling site, and a sea floor anchor which is connected to the anchor line at a distal end thereof. The mobile offshore drilling unit is brought to the offshore drilling site. Successively, for each respective connection unit, a dynamic positioning system at the mobile offshore drilling unit is operated to move the mobile offshore drilling unit to a position substantially vertically above the respective connection unit, a drilling unit anchor line comprising a connection member is lowered from the mobile offshore drilling unit so as to engage the respective connection unit, and the drilling unit anchor line is connected with the respective anchoring assembly via the connection unit and the connection member. Each drilling unit anchor line is tensioned from the mobile offshore drilling unit so as to anchor the mobile offshore drilling unit at the offshore drilling site via the plurality of anchoring assemblies.

BRIEF DESCRIPTION OF THE DRAWINGS

The present invention is described in greater detail below on the basis of embodiments and of the drawings in which.

DETAILED DESCRIPTION

FIGS. 1-5 illustrate steps of a method of temporarily anchoring a mobile offshore drilling unit (MODU) 20 at an offshore drilling site 11. The drilling site 11 may, for example, be a location where a new petroleum well is to be established or it may be a location where the MODU 20 is to be used for operations on an existing well (i.e., a well which has been previously drilled at the drilling site 11.)

Figure 6:
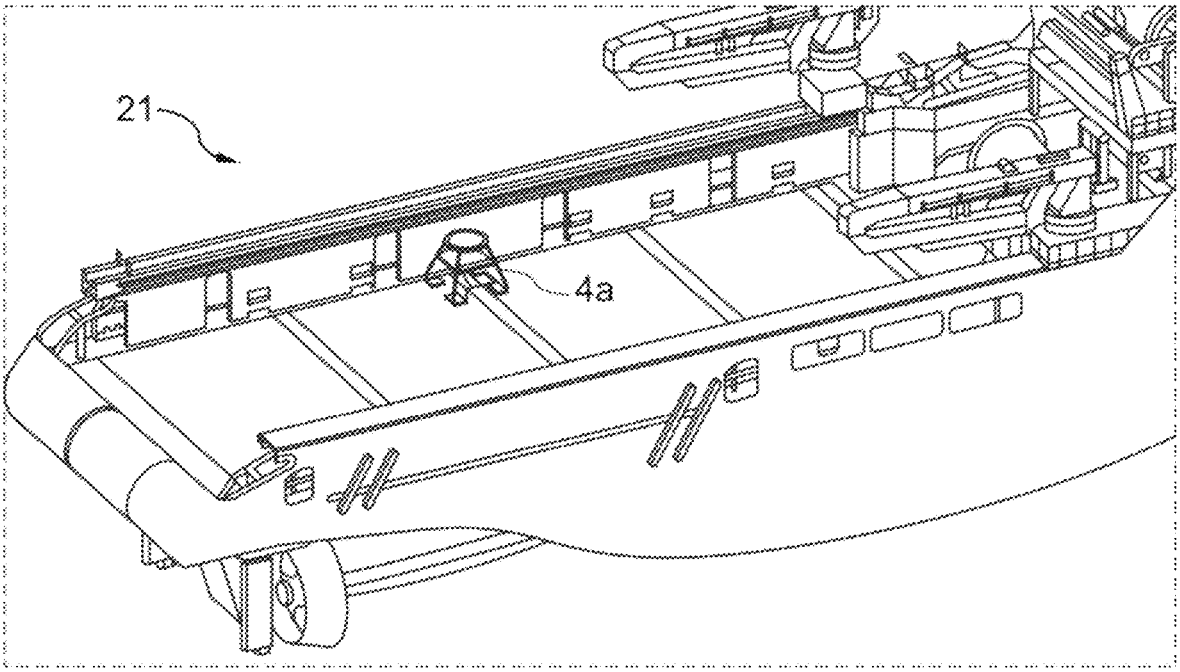
FIG. 6 illustrates an anchor installation vessel with a connection unit.

According to the method, prior to arrival of the MODU 20 at the drilling site 11, a plurality of anchoring assemblies 1*a-h* are laid out at the sea floor 13 around the drilling site 11. This can be performed with an anchor installation vessel 21. An example of an anchor installation vessel 21 is shown in FIG. 6.

Figure 1:
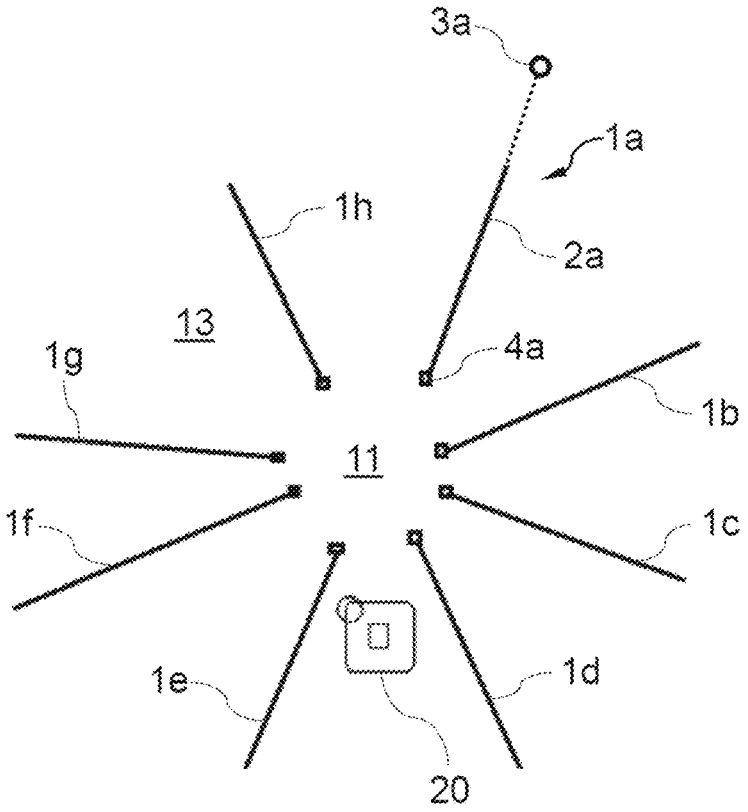
FIG. 1 illustrates schematically a first step of a method according to an example where, with the anchoring assemblies in place, the MODU is brought to the drilling site.

Anchoring assembly 1*a* is shown in FIG. 1 to comprise a connection unit 4*a*, an anchor line 2*a*, and a sea floor anchor 3*a*, however, the skilled reader will understand that the anchoring assemblies 1*b-h* have a similar configuration. The connection unit 4*a* is laid out adjacent the drilling site 11. The anchor line 2*a* is laid out so as to extend away from the drilling site 11, and a sea floor anchor 3*a* is connected to the anchor line 2*a* at a distal end thereof. The anchor line 2*a* may, for example, comprise chains, a wire rope, a fiber rope, or combinations thereof.

Eight anchoring assemblies 1*a-h* are laid out in the illustrated example, each extending in a different direction outwardly from the drilling site 11. Fewer or more than eight anchoring assemblies may be used.

With the anchoring assemblies 1*a-h* in place, the MODU 20 is brought to the drilling site 11. This is illustrated in FIG. 1 with the MODU 20 moving towards the drilling site 11. The MODU 20 may move to the drilling site 11 using its own propulsion machinery.

With the MODU 20 at the drilling site 11, the MODU 20 may be operated to move around to positions substantially vertically above each connection unit 4*a* and to successively connect thereto. This can be performed by operating a dynamic positioning (DP) propulsion system at the mobile offshore drilling unit 20.

A connection to the respective connection unit 4*a* is established at each position by lowering a drilling unit anchor line 22 having a connection member 23 to engage the connection unit 4*a*. This is illustrated in relation to FIGS. 7 and 8 which show an example connection unit 4*a*, part of the anchor line 2*a*, and the drilling unit anchor line 22 being lowered from the MODU 20 to engage and connect to the connection unit 4*a*, and thus to the anchoring assembly 1*a-h*, via the connection member 23.

Figure 2:
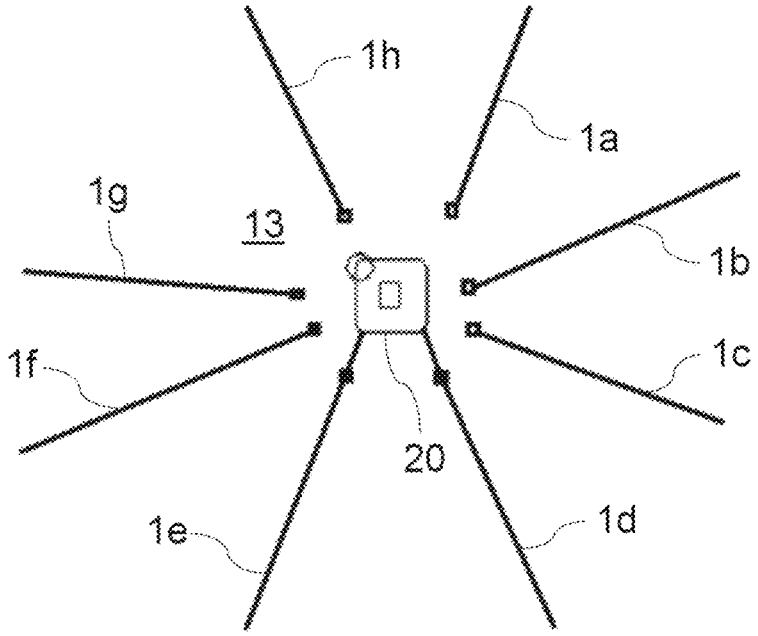
FIG. 2 illustrates schematically a second step of a method according to an example which shows that the MODU can be moved around the drilling site to successively connect to each connection unit and has here connected to the connection unit associated with a first two specific anchoring assemblies.
Figure 3:
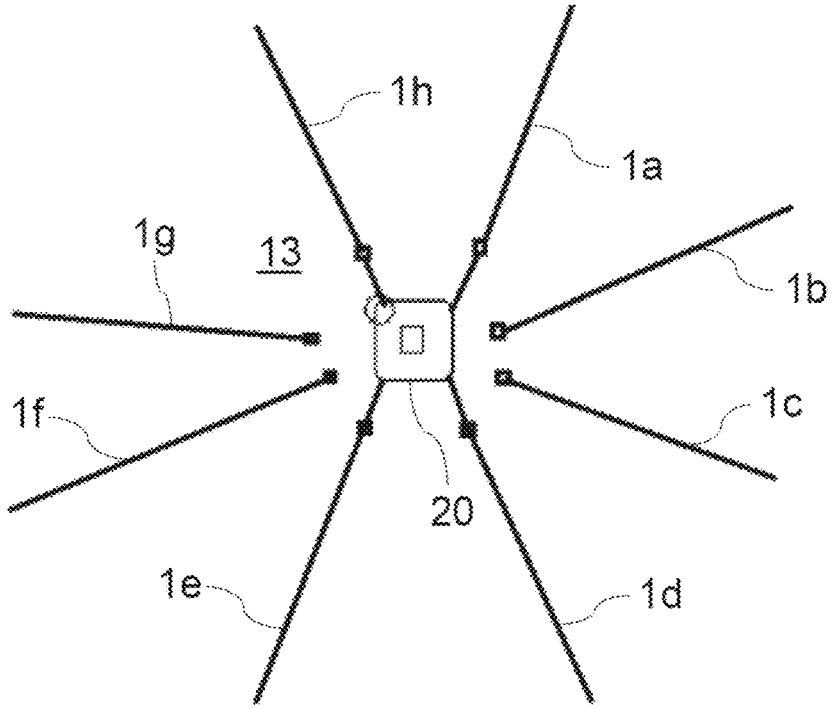
FIG. 3 illustrates schematically a third step of a method according to an example which shows the MODU having connected to the connection unit associated with a second two specific anchoring assemblies.
Figure 4:
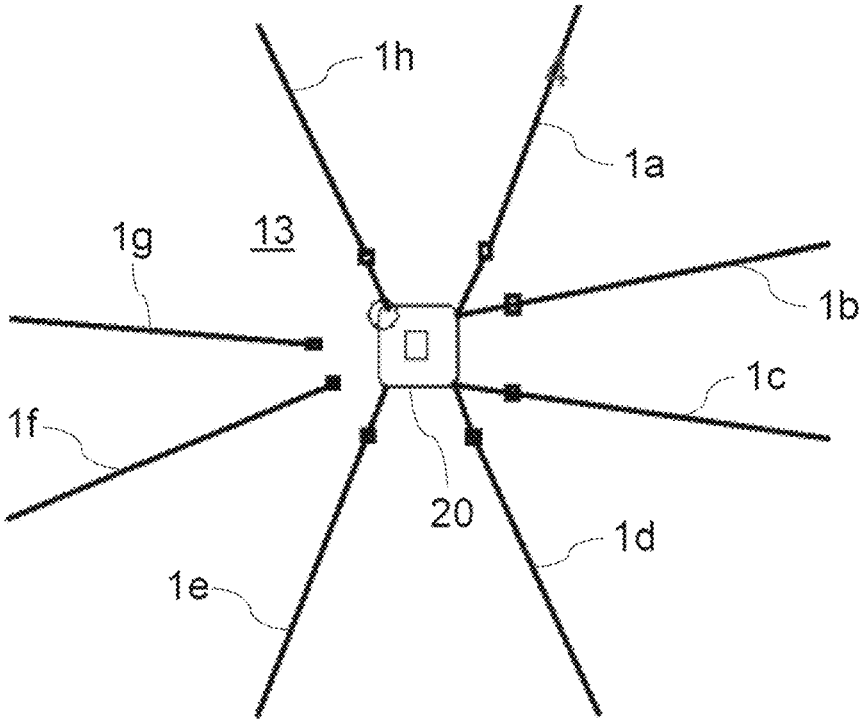
FIG. 4 illustrates schematically a fourth step of a method according to an example which shows the MODU having connected to the connection unit associated with a third two anchoring assemblies.
Figure 5:
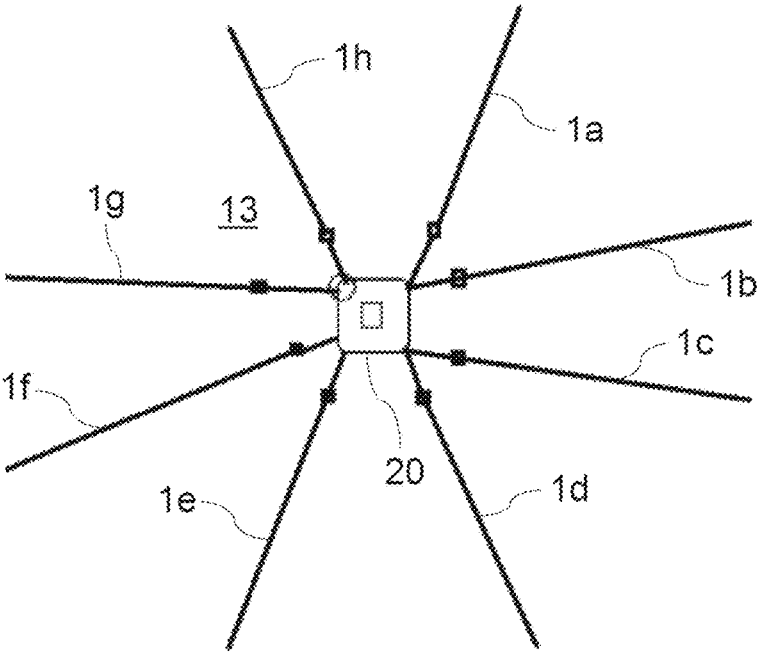
FIG. 5 illustrates schematically a fifth step of a method according to an example which shows the MODU having connected to the connection unit associated with a fourth two anchoring assemblies.

The MODU 20 can be moved around the drilling site 11 to successively connect to each connection unit 4*a* as illustrated in FIG. 2 (MODU 20 having connected to the connection unit 4*a* associated with anchoring assembly 1*d* and 1*e*), FIG. 3 (MODU 20 having connected to the connection unit 4*a* associated with anchoring assembly 1*a* and 1*h*), FIG. 4 (MODU 20 having connected to the connection unit 4*a* associated with anchoring assembly 1*b* and 1*c*), and FIG. 5 (MODU 20 having connected to the connection unit 4*a* associated with anchoring assembly 1*g* and 1*f*).

During these steps, the drilling unit anchor lines 22 may remain in a non-tensioned state, i.e., having sufficient slack so that the MODU 20 has freedom to move about even if a connection to respective anchoring assemblies 1*a-h* has been established. Drilling unit anchor lines 22 may optionally be paid out concurrently with moving the MODU 20 so as to allow sufficient freedom of movement of the MODU 20.

When the MODU 20 has connected to all the connection units 4*a*, each of the drilling unit anchor lines 22 are tensioned up from the MODU 20 so as to establish taut connections from the MODU 20 to each of the anchoring assemblies 1*a-h* and to thereby securely anchor the MODU 20 at the offshore drilling site 11 via the plurality of anchoring assemblies 1*a-h*. The MODU 20 may then, for example, perform a drilling operation, a well intervention operation, a decommissioning operation, an installation or removal operation, or other types of operations at the drilling site 11.

FIGS. 7-12 illustrate examples of suitable connection units 4*a* for use with methods as described herein. As illustrated in relation to FIG. 9, but also visible in FIGS. 10-12, the connection unit 4*a* may comprise a receptacle 30, such as a tapered receptacle, which is operable to receive the connection member 23. When lowering the respective drilling unit anchor line 22, the connection member 23 can be lowered into the receptacle 30 and be securely engaged with the connection unit 4*a*. A locking mechanism can be provided to lock the connection member 23 in place in the receptacle 30. A remotely operated underwater vehicle (ROV) 25 may be used to assist guiding the connection member 23 relative to the receptacle 30 and/or to monitor (for example, via a camera and a signal connection to a control room on the MODU 20) operations subsea. The locking of the connection member 23 in the receptacle 30 may be performed in any suitable manner, such as via an automatic mechanism upon landing, via a remotely controlled actuator at the connection member 23 and/or the connection unit 4*a*, manually by the ROV via a tool interface at the connection member 23 and/or the connection unit 4*a*, or otherwise.

Figure 7:
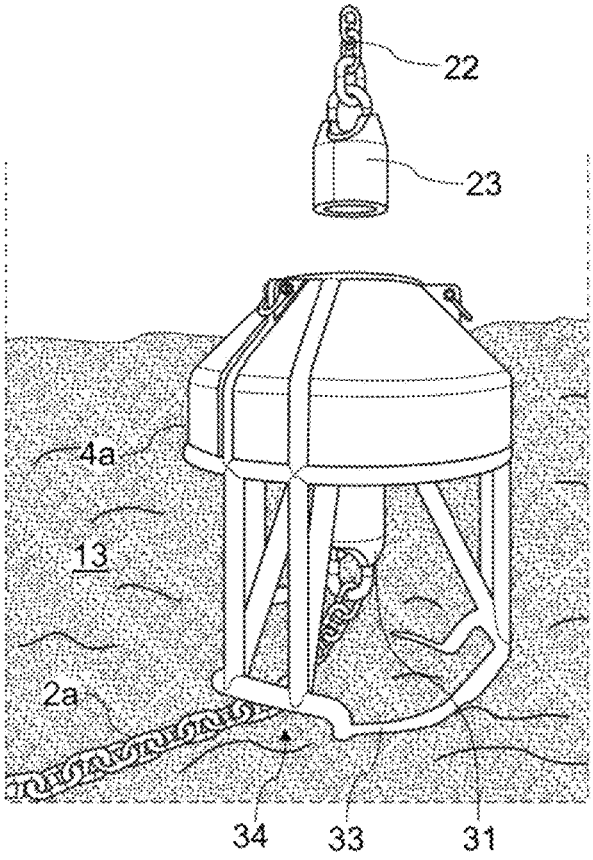
FIG. 7 illustrates a connection unit and associated components where the ground support members may comprise or define a passage and/or an opening at which the ground support members do not engage the sea floor, and through which an anchor line can extend.
Figure 8:
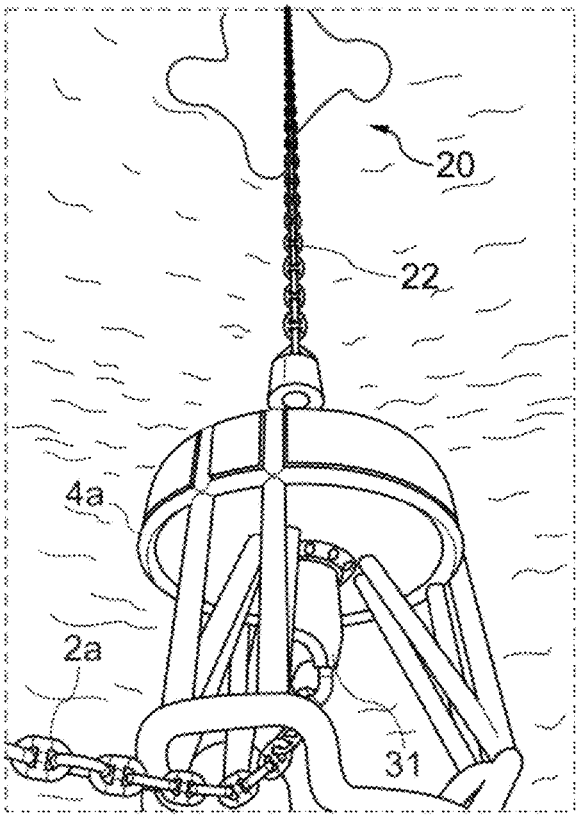
FIG. 8 illustrates a connection unit and associated components where the connection unit comprises an anchor line connector which is configured to connect to the anchor line and which is arranged at an opposite side of the receptacle on the connection unit.
Figure 9:
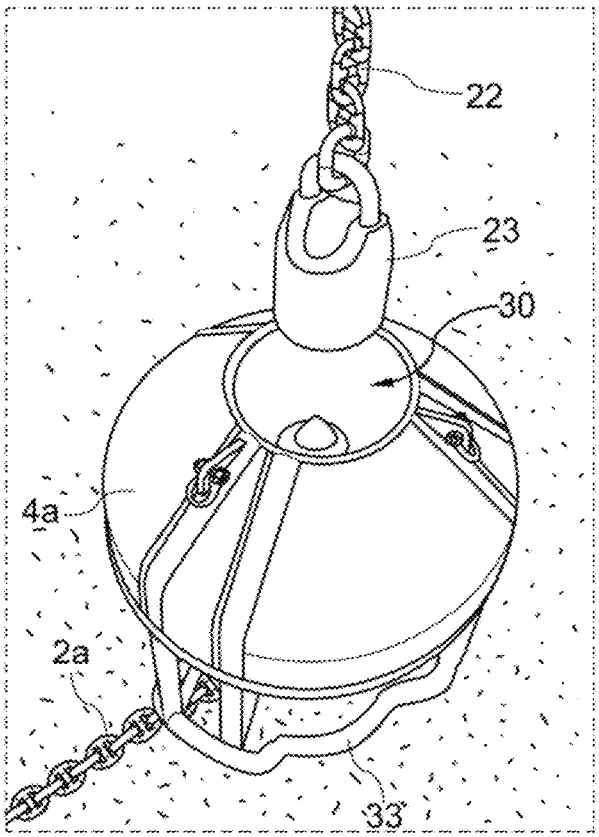
FIG. 9 illustrates a connection unit which comprises a receptacle, such as a tapered receptacle, which is operable to receive the connection member.

As illustrated in relation to FIGS. 7 and 8, but also visible in FIGS. 9-12, the connection unit 4*a* may comprise an anchor line connector 31 which is configured for connection to the anchor line 2*a* and which is arranged at an opposite side of the receptacle 30 on the connection unit 4*a*. The receptacle 30 faces upward when the connection unit 4*a* is arranged on the sea floor 13, and the anchor line connector 31 is thus arranged on a downward-facing part of the connection unit 4*a*.

In any of the examples or embodiments described herein, the anchor line connector 31 may advantageously be arranged centrally, such as coinciding with a vertical center axis, at the connection unit 4*a*. It may, additionally or alternatively, advantageously be arranged below the receptacle 30.

The connection unit 4*a* may comprise ground support members 33 which are configured for supporting the connection unit 4*a* at the sea floor 13.

In any of the examples or embodiments described herein, the anchor line connector 31 may advantageously be arranged between the ground support members 33 and the receptacle 30 so that the anchor line connector 31 does not engage the sea floor 13 when the connection unit 4*a* is positioned on the sea floor 13.

The ground support members 33 may optionally comprise or define a passage and/or an opening 34 at which the ground support members 33 do not engage the sea floor 13, and through which the anchor line 2*a* can extend, as illustrated in FIG. 7. When laying out the anchoring assemblies 1*a-h*, each connection unit 4*a* can be placed with the anchor line 2*a* extending at the sea floor 13 through the opening 34, and with the anchor line 2*a* connected to the anchor line connector 31. This provides for a secure and stable positioning of the connection unit 4*a* at the sea floor 13 while providing good load transfer between the drilling unit anchor line 22 and the anchor line 2*a* when tensioned up.

Figure 10:
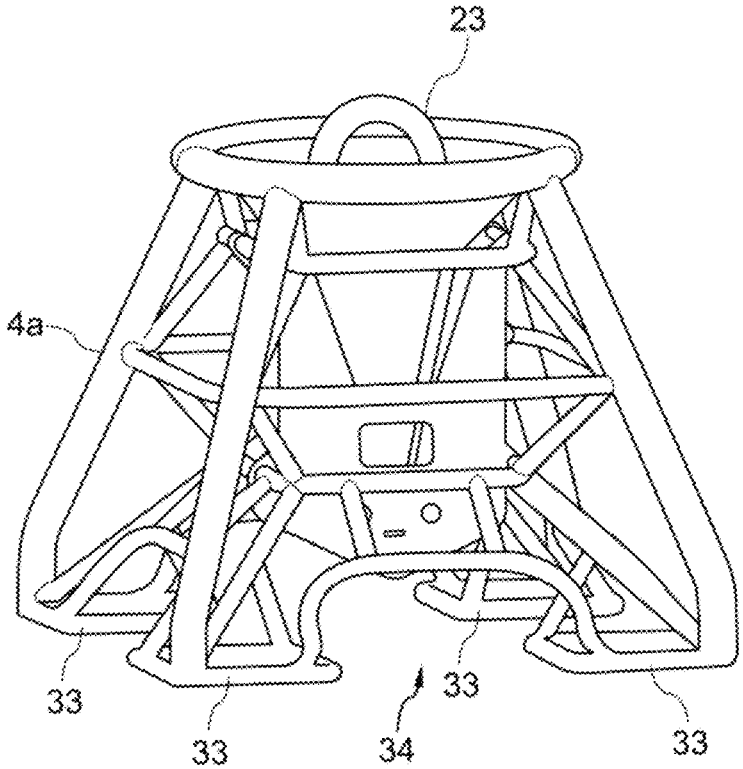
FIG. 10 illustrates a connection unit which comprises a receptacle, such as a tapered receptacle, which is operable to receive the connection member.
Figure 11:
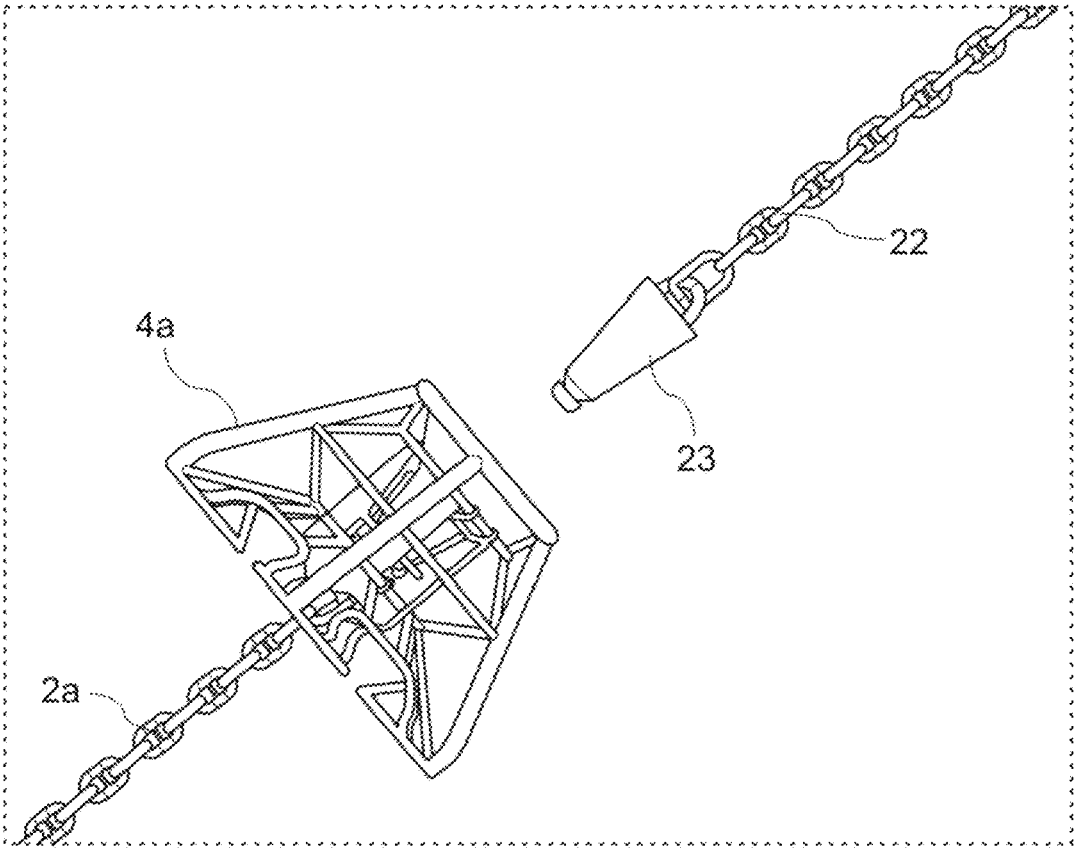
FIG. 11 illustrates a connection unit which is operable to receive the connection member.
Figure 12:
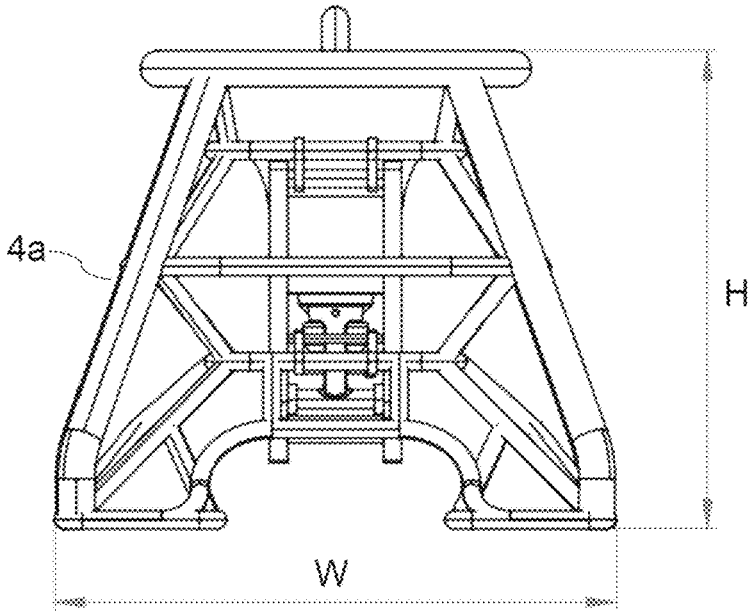
FIG. 12 illustrates a connection unit having a largest width at its lower part (i.e., the part engaging the sea floor) which is greater than a largest height of the connection unit.

FIGS. 10-12 illustrate another example of a connection unit 4*a*. The connection unit 4*a* of FIGS. 10-12 may comprise one or several of the features described above. As illustrated in relation to FIG. 12, but applicable to any example or embodiment described herein, the connection unit 4*a* may have a largest width W at its lower part (i.e., the part engaging the sea floor 13) which is greater than a largest height H of the connection unit 4*a*.

Laying out the plurality of anchoring assemblies 1*a-h* at the sea floor 13 may advantageously be performed with an anchor installation vessel 21 prior to bringing the MODU 20 to the offshore drilling site 11.

Advantageously, the step of connecting the drilling unit anchor lines 22 with the respective anchoring assemblies 1*a-h* and/or the step of tensioning up the drilling unit anchor lines 22 is/are performed without involvement of an anchor installation vessel 21 but is performed by (and from) the MODU 20 alone.

After completion of the operation at the drilling site 11, the MODU 20 may be prepared to leave the drilling site 11 principally by carrying out the above steps in reverse. This may include reeling out the drilling unit anchor lines 22 and disconnecting each connection unit 4*a* from the connection members 23. The drilling unit anchor lines 22 may, for example, be reeled out sufficiently far so as to place the connection units 4*a* at the sea floor 13 before disconnecting the connection units 4*a* from the connection members 23. In the disconnect phase there may, however, not be a need for the MODU 20 to move around (like in the connection operation); the connection units 4*a* may simply be lowered down onto the sea floor 13 at the drilling site 11 and be disconnected. If equipment (such as pipelines) exists on the sea floor 13, one may nevertheless also move the MODU 20 during the disconnect phase so as to lay down the connection units 4*a* at suitable locations at the sea floor 13, spaced from the equipment.

The MODU 20 may then leave the drilling site 11, for example, by its own propulsion or by towing.

The anchoring assemblies 1*a-h* can be removed/retrieved from the sea floor 13 via an anchor installation vessel 21. The removal/retrieval of the anchoring assemblies 1*a-h* can advantageously be performed after the MODU 20 has left the drilling site 11, for example, when a suitable anchor installation vessel 21 becomes available.

Disconnecting the connection units 4*a* from the connection members 23 may in an advantageous example be performed remotely from the MODU 20. Such an example may include operating a hydroacoustic transmitter from the MODU 20 to activate a release actuator arranged at the connection unit 4*a* or at the connection member 23 so as to release the connection unit 4*a* from the connection member 23. Disconnection may alternatively be performed by operating a remotely operated underwater vehicle (ROV) 25 from the MODU 20 to release the connection unit 4*a* from the connection member 23, for example, via a tool interface at the connection unit 4*a* or the connection member 23 being engageable by the ROV 25.

The method may advantageously include logging a location, such as a GPS-identified location, of each connection unit 4*a* at the sea floor 13 when these are laid out. The location can, for example, be represented by latitude and longitude coordinates. The location can be logged by appropriate equipment on the anchor installation vessel 21 and stored. Detailed information about the individual locations of the connection units 4*a* can thereby be provided. The logged locations are then provided to the MODU 20 prior to the MODU 20 moving towards and connecting to the connection units 4*a*. The dynamic positioning (DP) system of the MODU 20 can then be used to move the MODU 20 to the respective provided location so as to more efficiently position the MODU 20 vertically above the connection unit 4*a*.

Figure 13:
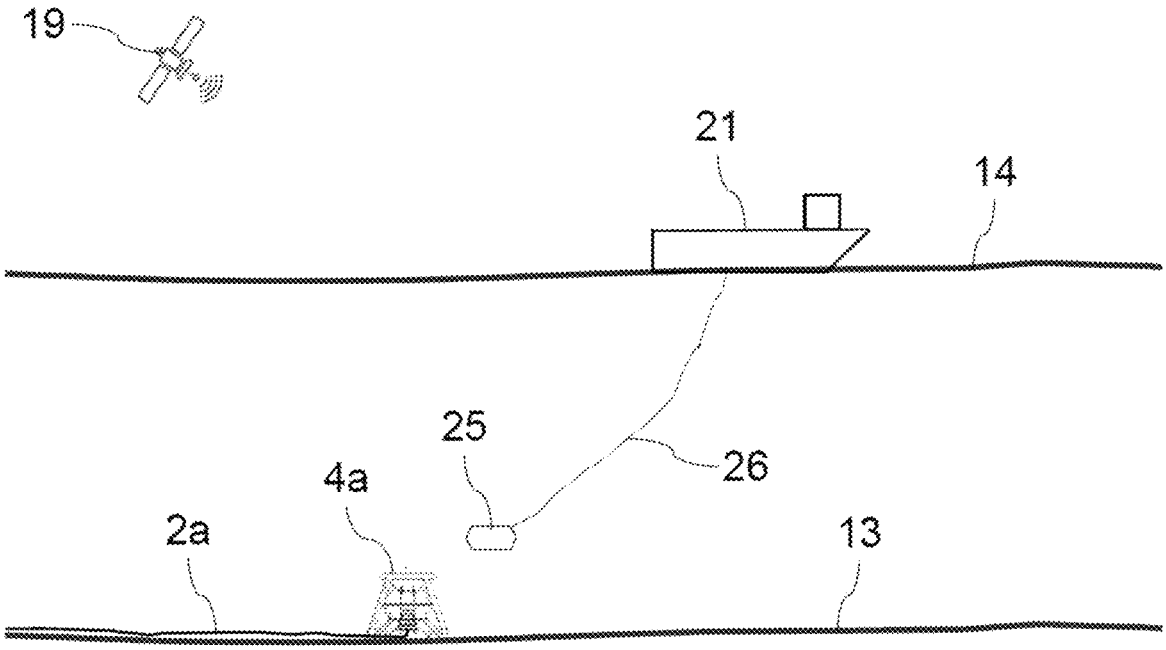
FIG. 13 illustrates schematically and not to scale a first example in which position detection and/or position control is employed in the method of the present invention.
Figure 14:
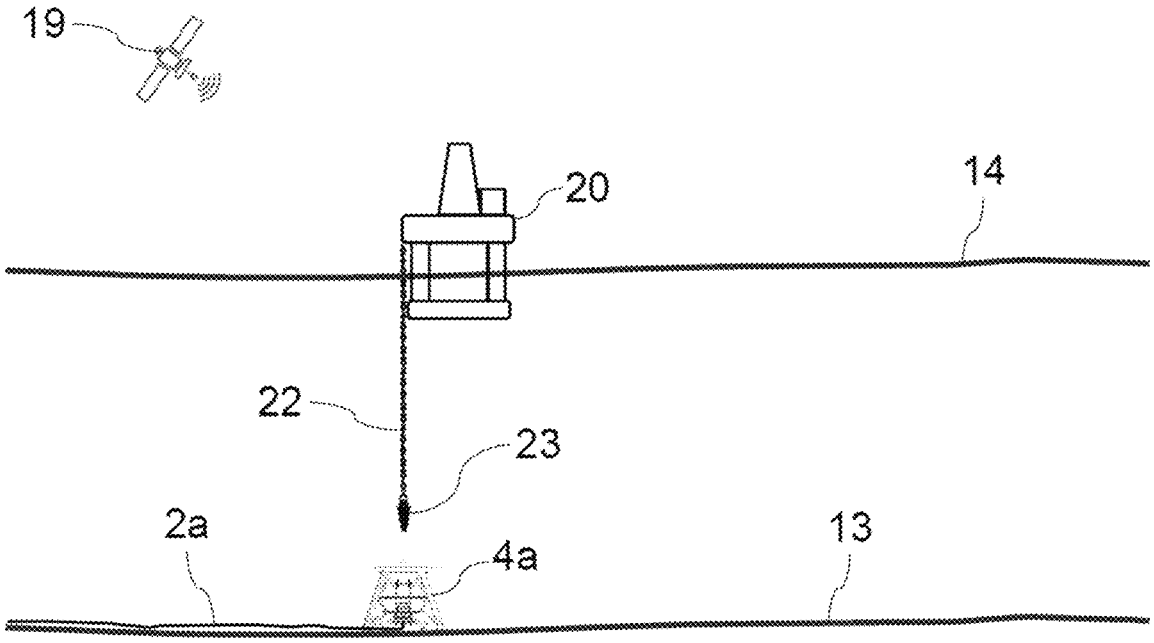
FIG. 14 illustrates schematically and not to scale a second example in which position detection and/or position control is employed in the method of the present invention.

FIGS. 13 and 14 illustrate (schematically and not to scale) examples in which position detection and/or position control is employed in the method.

As illustrated in FIG. 13, logging the location of each connection unit 4*a* at the sea floor 13 can be performed by determining, via signals from one or more satellites 19 (such as GPS satellites), a position of the anchor installation vessel 21 on the sea surface 14, and operating an ROV 25 to a position adjacent to the connection unit 4*a*. The ROV 25 can, for example, be operated from the anchor installation vessel 21 via a cable 26. The ROV position may, for example, be selected as directly above the connection unit 4*a*, or directly adjacent on a side of the connection unit 4*a*. A relative distance between the anchor installation vessel 21 and the ROV 25 can then be determined, for example, via a hydroacoustic transponder link. The location of the connection unit 4*a* at the sea floor 13 can then be established, for example, calculated, based on the position of the anchor installation vessel 21 corrected for the relative distance between the anchor installation vessel 21 and the remotely operated underwater vehicle 25.

In order to provide more accurate measurements, the ROV 25 may be landed on the connection unit 4*a* and temporarily fixed thereto while establishing the relative distance between the anchor installation vessel 21 and the ROV 25.

Each connection unit 4*a* may alternatively comprise a signal transmitter, such as a hydroacoustic signal transmitter, and the location of the connection unit 4*a* at the sea floor 13 can be established, for example, calculated, based on the position of the anchor installation vessel 21 as corrected for the relative distance between the anchor installation vessel 21 and the connection unit 4*a*.

After finishing the laying out of the anchoring assemblies 1*a-h*, the location of each connection unit 4*a* at the sea floor 13 can be transmitted from the anchor installation vessel 21 to the MODU 20. If such location data has been received, the dynamic positioning system of the MODU 20 can be operated to move the MODU 20 successively to positions above each location in order to connect the drilling unit anchor lines 22 to the connection units 4*a*.

Optionally or additionally, each connection unit 4*a* may comprise a signal transmitter, such as a hydroacoustic signal transmitter, and the method can include receiving a signal from the signal transmitter to determine a relative horizontal distance between the MODU 20 and the connection unit 4*a* based on the signal. Based on such a signal, the dynamic positioning system at the MODU 20 can be operated to move the MODU 20 the corresponding distance towards the connection unit 4*a*.

The method may advantageously include identifying a relative horizontal distance between the connection member 23 and the receptacle 30 while lowering a respective drilling unit anchor line 22 or while the drilling unit anchor line 22 is suspended into the sea from the MODU 20. The relative horizontal distance is then used to operate the dynamic positioning system at the MODU 20 to move the MODU 20 a corresponding horizontal distance so as to position the connection member 23 vertically above the receptacle 30.

Identifying the relative horizontal distance may, for example, be performed when the connection member 23 is a few meters or less above the sea floor 13 and/or the connection unit 4*a*. Identifying the relative horizontal distance may optionally be performed continuously or repeatedly during handling of a respective anchor line 22, such as during lowering of the drilling unit anchor line 22 or during pauses is the lowering of the drilling unit anchor line 22.

The relative horizontal distance between the connection member 23 and the receptacle 30 may be established via an ROV 25.

Alternatively or additionally, each connection unit 4*a* may comprise a signal transmitter, such as a hydroacoustic signal transmitter, and each connection member 23 may comprise a corresponding signal receiver, such as a hydroacoustic signal receiver, which is operable to receive a signal from the signal transmitter. The signal may be used to determine (e.g., by calculation) a distance between the connection unit 4*a* and the connection member 23.

The connection member 23 may comprise a compass, whereby a direction towards the connection unit 4*a* can be determined, or the connection unit 4*a* may comprise a compass whereby a direction towards the connection member 23 can be determined. A reading from the compass can be used in conjunction with the signal to determine a distance and direction between the connection unit 4*a* and the connection member 23.

The determined distance can be provided to the MODU 20 as a signal directly representative of the distance, or as a raw signal (or signals) from which the distance can be calculated at the MODU 20. The MODU 20 may in either case receive a signal indicative of the horizontal distance between the connection member 23 and the receptacle 30 based on measurements from the signal receiver/transmitter. Signal transfer from the connection member 23 to the MODU 20 may be performed wirelessly (e.g., via a hydroacoustic signal link), or via a signal cable connected to the connection member 23 and lowered into the sea together with the drilling unit anchor line 22.

Alternatively, the transmitter may be positioned on the connection member 23 and the receiver on the connection unit 4*a* to provide the same functionality and operate in the same way.

When having information on the horizontal distance between the connection member 23 and the receptacle 30, the dynamic positioning system at the MODU 20 can be operated to move the MODU 20 a corresponding horizontal distance so as to position the connection member 23 vertically above the receptacle 30. Such examples and embodiments may reduce the need for an ROV 25 to support the operation of landing the connection member 23 in the receptacle 30.

Via the signal transmitter and receiver, the MODU 20 may, additionally or alternatively, receive a signal which is indicative of a relative vertical distance between the connection member 23 and the receptacle 30, and may be operated to lower the respective drilling unit anchor line 22 from the MODU 20 in response to the vertical distance signal. An improved control of the landing of the connection member 23 in the receptacle 30 is thereby provided.

Figure 15:
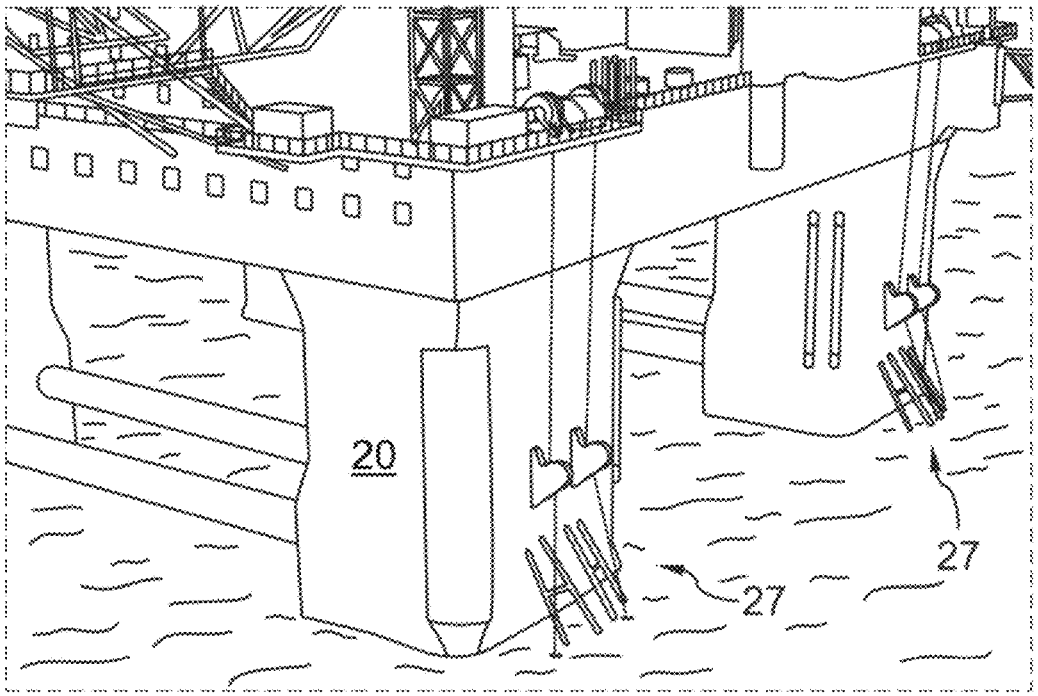
FIG. 15 illustrates a first aspect of a MODU which is suitable for use with the examples of the present invention.
Figure 16:
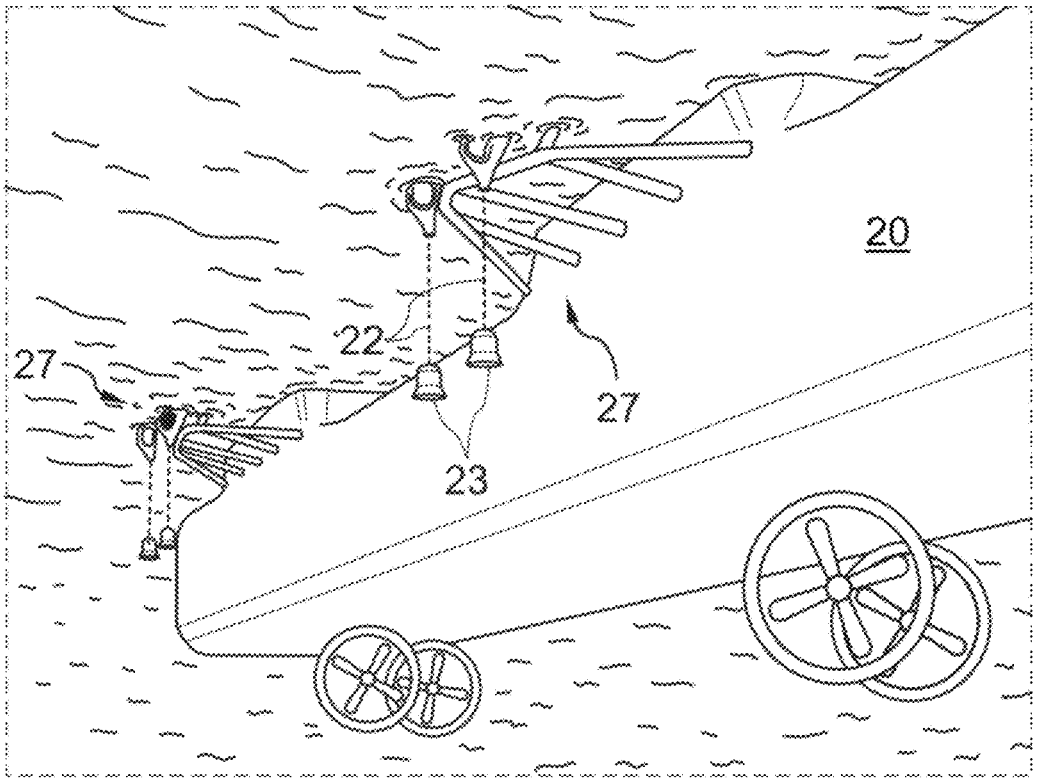
FIG. 16 illustrates a second aspect of a MODU which is suitable for use with the examples of the present invention.

In some examples, the MODU 20 may have a plurality of anchor line supports 27, as illustrated in FIGS. 15 and 16. The anchor line supports 27 may, for example, be fairleads and associated structure positioned at different locations of the MODU 20, for example, at different locations about the outer periphery of the hull of the MODU 20. Each drilling unit anchor line 22 may be associated with one such anchor line support, which operates to guide the drilling unit anchor line 22 as it is being reeled out and lowered into the sea. In any of the examples or embodiments described herein, moving the MODU 20 to a position substantially vertically above a respective connection unit 4*a* may comprise moving the MODU 20 to a position at which a respective anchor line support 27 is substantially vertically above the respective connection unit 4*a*.

In any of the examples or embodiments described herein, the connection units 4*a* and/or the connection member 23 may comprise a sensor which is operable to identify a connection status between the connection unit 4*a* and the connection member 23. The sensor may be configured to transmit the connection status to the MODU 20, for example, via a hydroacoustic transponder link. The connection units 4*a* and/or the connection member 23 may additionally or alternatively comprise a visual indicator of the connection status, which can be read by a camera on an ROV 25.

Figure 17:
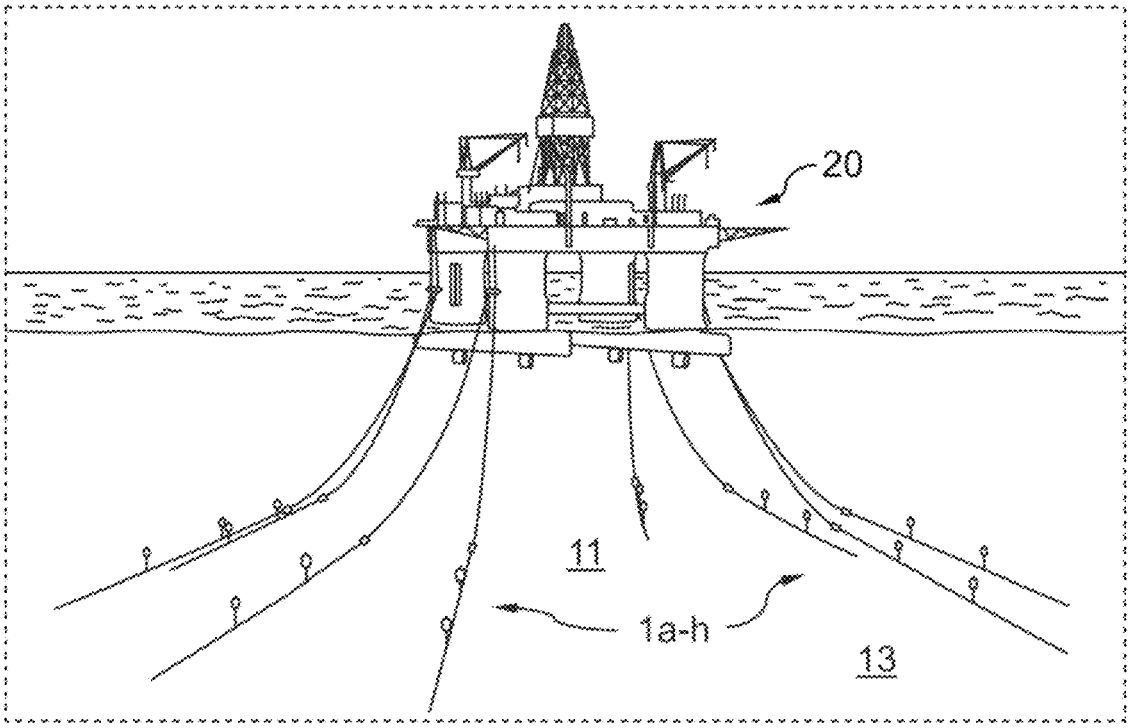
FIG. 17 illustrates a MODU being temporarily anchored via anchoring assemblies.
Figure 18:
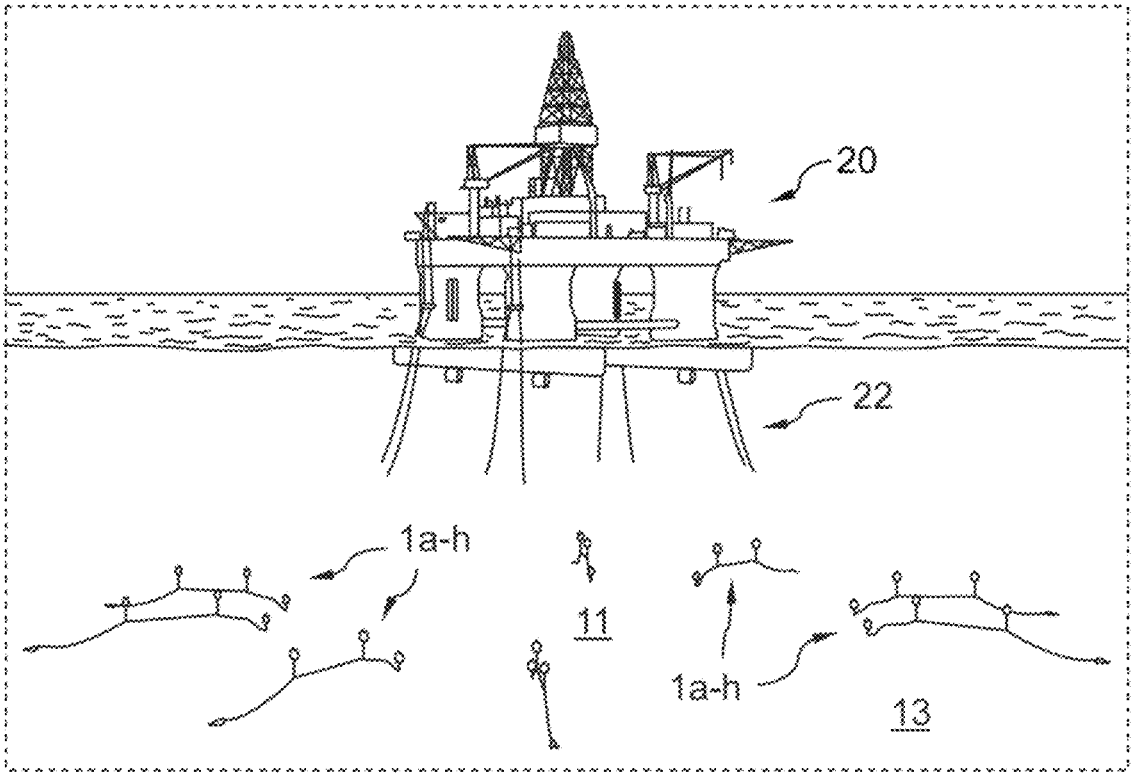
FIG. 18 illustrates the MODU after disconnection, with the anchoring assemblies having been left on the sea floor, and the MODU leaving the drilling site.

FIG. 17 illustrates a MODU 20 which is temporarily anchored via the anchoring assemblies 1*a-h*. FIG. 18 illustrates the MODU 20 after disconnection with the anchoring assemblies 1*a-h* left on the sea floor 13 and the MODU 20 leaving the drilling site 11.

Efficient methods of temporarily anchoring a mobile offshore drilling unit (MODU) 20 at an offshore drilling site 11 are provided according to examples and embodiments described herein. With the examples and embodiments described herein, the MODU 20 and anchor installation vessel(s) 21 may be operated more efficiently and a reduction in "on-hire" operational hours of the MODU 20 and/or anchor installation vessel(s) 21 can be provided. The methods can in some cases allow for certain operations to be performed more efficiently with lighter and cheaper vessels. The methods can provide a reduced weather dependency in that there is less (or no) reliance on anchor installation vessel(s) 21 during connection to the anchoring assemblies 1*a-h*. The possibility for better operational planning can in some cases reduce the need to engage anchor installation vessel(s) 21 at short notice, i.e., at spot market day rates and with the risk of operational delays. This can provide for a better overall utilization of equipment, cost efficiency, and reduce energy usage and emissions.

The following numbered clauses outline further inventive examples and embodiments:

Clause 1. A method of temporarily anchoring a mobile offshore drilling unit (20) at an offshore drilling site (11), the method comprising:

laying out a plurality of anchoring assemblies (1*a-h*) at a sea floor (13), each anchoring assembly (1*a-h*) comprising a connection unit (4*a*) being laid out adjacent the drilling site (11), an anchor line (2*a*) extending away from the drilling site (11), and a sea floor anchor (3*a*) connected to the anchor line (2*a*) at a distal end thereof;

bringing the mobile offshore drilling unit (20) to the offshore drilling site (11);

successively for each connection unit (4*a*), operating a dynamic positioning system at the mobile offshore drilling unit (20) to move the mobile offshore drilling unit (20) to a position substantially vertically above the respective connection unit (4*a*), lowering, from the mobile offshore drilling unit (20), one of a plurality of drilling unit anchor lines (22) having a connection member (23) to engage the connection unit (4*a*), and connecting the one drilling unit anchor line (22) with the respective anchoring assembly (1*a-h*) via the connection unit (4*a*) and connection member (23); and tensioning up each of the plurality of drilling unit anchor lines (22) from the mobile offshore drilling unit (20) so as to anchor the mobile offshore drilling unit (20) at the offshore drilling site (11) via the plurality of anchoring assemblies (1*a-h*).

Clause 2. The method according to clause 1, wherein the step of laying out the plurality of anchoring assemblies (1*a-h*) at the sea floor (13) is performed with an anchor installation vessel (21).

Clause 3. The method according to any preceding clause, wherein the step of laying out the plurality of anchoring assemblies (1*a-h*) at the sea floor (13) is performed with an anchor installation vessel (21) prior to the step of bringing the mobile offshore drilling unit (20) to the offshore drilling site (11).

Clause 4. The method according to any preceding clause, comprising performing a drilling operation from the mobile offshore drilling unit (20) with the mobile offshore drilling unit (20) anchored at the drilling site (11) via the plurality of anchoring assemblies (1*a-h*).

Clause 5. The method according to any preceding clause, wherein the step of connecting the one drilling unit anchor line (22) with the respective anchoring assembly (1*a-h*) and/or the step of tensioning up each of the plurality of drilling unit anchor lines (22) is/are performed without involvement of an anchor installation vessel (21).

Clause 6. The method according to any preceding clause, further comprising:

reeling out the plurality of drilling unit anchor lines (22) from the mobile offshore drilling unit (20);

disconnecting each of the connection units (4*a*) from the connection members (23); and removing the mobile offshore drilling unit (20) from the offshore drilling site (11).

Clause 7. The method according to any preceding clause, comprising removing the plurality of anchoring assemblies (1*a-h*) from the sea floor (13) via an anchor installation vessel (21).

Clause 8. The method according to any preceding clause, comprising removing the plurality of anchoring assemblies (1*a-h*) from the sea floor (13) via an anchor installation vessel (21) after the mobile offshore drilling unit (20) has been removed from the offshore drilling site (11).

Clause 9. The method according to any preceding clause, wherein the step of disconnecting each of the connection units (4*a*) from the connection members (23) comprises:

operating a hydroacoustic transmitter from the mobile offshore drilling unit (20) to activate a release actuator arranged at the connection unit (4*a*) or at the connection member (23), so as to release the connection unit (4*a*) from the connection member (23), or operating a remotely operated underwater vehicle (ROV) from the mobile offshore drilling unit (20) to release the connection unit (4*a*) from the connection member (23).

Clause 10. The method according to any preceding clause, wherein each connection unit (4*a*) comprises a receptacle (30), such as a tapered receptacle, which is operable to receive the connection member (23), and the step of lowering one of the plurality of drilling unit anchor lines (22) comprises lowering the connection member (23) into the receptacle (30).

Clause 11. The method according to any preceding clause, wherein the step of connecting the drilling unit anchor line (22) with the respective anchoring assembly (1*a-h*) via the connection unit (4*a*) and connection member (23) comprises operating a locking mechanism to lock the connection member (23) in place in the receptacle (30).

Clause 12. The method according to any preceding clause, wherein each connection unit (4*a*) comprises an anchor line connector (31), the anchor line connector (31) being configured for connection to the anchor line (2*a*) and being arranged at an opposite side of the connection unit (4*a*) relative to the receptacle (30).

Clause 13. The method according to any preceding clause, wherein, each connection unit (4*a*) comprises ground support members (33) which are configured for supporting the connection unit (4*a*) at the sea floor (13) with the receptacle (30) facing upwardly, and the step of laying out the plurality of anchoring assemblies (1*a-h*) comprises placing each connection unit (4*a*) with the ground support members (33) on the sea floor (13).

Clause 14. The method according to any preceding clause, wherein, the ground support members (33) comprise or define a passage or opening (34) at which the ground support members (33) do not engage the sea floor (13), and through which the anchor line (2*a*) can extend, and the step of laying out the plurality of anchoring assemblies (1*a-h*) comprises placing each connection unit (4*a*) with the anchor line (2*a*) extending at the sea floor (13) through the opening (34), and with the anchor line (2*a*) connected to the anchor line connector (31).

Clause 15. The method according to any preceding clause, wherein a largest width (W) of the connection unit (4*a*) is greater than a largest height (H) of the connection unit (4*a*).

Clause 16. The method according to any preceding clause, wherein, the step of laying out the plurality of anchoring assemblies (1*a-h*) at the sea floor (13) comprises logging a location of each connection unit (4*a*) at the sea floor (13), and the step of operating the dynamic positioning system at the mobile offshore drilling unit (20) to move the mobile offshore drilling unit (20) to the position substantially vertically above the respective connection unit (4*a*) comprises using the logged location of the respective connection unit (4*a*) to control the dynamic positioning system.

Clause 17. The method according to any preceding clause, wherein the step of logging the location of each connection unit (4*a*) at the sea floor (13) comprises:

determining, for example, via signals from one or more satellites (19), a position of the anchor installation vessel (21) on the sea surface (14);

determining a distance between the anchor installation vessel (21) and the connection unit (4*a*), for example, via a hydroacoustic transponder link; and establishing the location of the connection unit (4*a*) at the sea floor (13) based on the position of the anchor installation vessel (21) corrected for the relative distance between the anchor installation vessel (21) and the remotely operated underwater vehicle (25).

Clause 18. The method according to any preceding clause, wherein the step of logging the location of each connection unit (4*a*) at the sea floor (13) comprises:

determining, for example, via signals from one or more satellites (19), a position of the anchor installation vessel (21) on the sea surface (14);

operating a remotely operated underwater vehicle (25) to a position adjacent to, such as vertically above, the connection unit (4*a*);

determining a distance between the anchor installation vessel (21) and the remotely operated underwater vehicle (25), for example, via a hydroacoustic transponder link; and establishing the location of the connection unit (4*a*) at the sea floor (13) based on the position of the anchor installation vessel (21) corrected for the relative distance between the anchor installation vessel (21) and the remotely operated underwater vehicle (25).

Clause 19. The method according to any preceding clause, wherein the step of determining the relative distance between the anchor installation vessel (21) and the remotely operated underwater vehicle (25) comprises:

landing the remotely operated underwater vehicle (25) on the connection unit (4*a*); and temporarily holding the remotely operated underwater vehicle (25) fixed on the connection unit (4*a*) while establishing the distance between the anchor installation vessel (21) and the remotely operated underwater vehicle (25).

Clause 20. The method according to any preceding clause, comprising transmitting the location of each connection unit (4*a*) at the sea floor (13) from the anchor installation vessel (21) to the mobile offshore drilling unit (20).

Clause 21. The method according to any preceding clause, wherein the step of operating the dynamic positioning system at the mobile offshore drilling unit (20) to move the mobile offshore drilling unit (20) to a position substantially vertically above the respective connection unit (4*a*) comprises moving the mobile offshore drilling unit (20) to a position substantially vertically above the location of each connection unit (4*a*) at the sea floor (13) received from the anchor installation vessel (21).

Clause 22. The method according to any preceding clause, wherein each connection unit (4*a*) comprises a signal transmitter, such as a hydroacoustic signal transmitter, and the method comprises:

receiving a signal from the signal transmitter and determining a horizontal distance between the mobile offshore drilling unit (20) and the connection unit (4*a*); and operating the dynamic positioning system at the mobile offshore drilling unit (20) to move the mobile offshore drilling unit (20) towards the connection unit (4*a*) a distance corresponding to the determined horizontal distance between mobile offshore drilling unit (20) and the connection unit (4*a*).

Clause 23. The method according to any preceding clause, the method comprising:

identifying a horizontal distance between the connection member (23) and the receptacle (30), and operating the dynamic positioning system at the mobile offshore drilling unit (20) to move the mobile offshore drilling unit (20) a horizontal distance corresponding to the horizontal distance between the connection member (23) and the receptacle (30) so as to position the connection member (23) vertically above the receptacle (30).

Clause 24. The method according to any preceding clause, wherein, each connection unit (4*a*) comprises a signal transmitter or receiver, such as a hydroacoustic signal transmitter or receiver, and each connection member (23) comprises a corresponding signal receiver or transmitter, such as a hydroacoustic signal receiver or transmitter, the signal transmitter and receiver being operable to produce a signal indicative of a horizontal distance between the connection member (23) and the receptacle (30), and the method comprises:

receiving the signal at the mobile offshore drilling unit (20); and operating the dynamic positioning system at the mobile offshore drilling unit (20) to move the mobile offshore drilling unit (20) a horizontal distance in response to the signal so as to position the connection member (23) vertically above the receptacle (30).

Clause 25. The method according to any preceding clause, wherein, each connection unit (4*a*) comprises a signal transmitter or receiver, such as a hydroacoustic signal transmitter or receiver, and each connection member (23) comprises a corresponding signal receiver or transmitter, such as a hydroacoustic signal receiver or transmitter, the signal transmitter and receiver being operable to produce a signal indicative of a vertical distance between the connection member (23) and the receptacle (30), and the method comprises:

receiving the signal at the mobile offshore drilling unit (20); and lowering the one of a plurality of drilling unit anchor lines (22) from the mobile offshore drilling unit (20) in response to the signal so as to land the connection member (23) in the receptacle (30).

Clause 26. The method according to any preceding clause, wherein, the mobile offshore drilling unit (20) comprises a plurality of anchor line supports, such as fairleads, positioned at different locations of the mobile offshore drilling unit (20), each drilling unit anchor line (22) being associated with one anchor line support, and the step of operating the dynamic positioning system at the mobile offshore drilling unit (20) to move the mobile offshore drilling unit (20) to the position substantially vertically above the respective connection unit (4*a*) comprises moving the mobile offshore drilling unit (20) to a position at which a respective anchor line support is substantially vertically above the respective connection unit (4*a*).

Clause 27. A connection unit (4*a*) which is configured to be laid on a sea floor (13) adjacent a drilling site (11) as part of an anchoring assembly (1*a-h*), the connection unit (4*a*) comprising a receptacle (30), such as a tapered receptacle, which is configured to receive a connection member (23).

Clause 28. The connection unit (4*a*) according to any preceding clause, wherein the connection unit (4*a*) comprises a locking mechanism to lock the connection member (23) in place in the receptacle (30).

Clause 29. The connection unit (4*a*) according to any preceding clause, wherein the connection unit (4*a*) comprises an anchor line connector (31), the anchor line connector (31) being configured for connection to an anchor line (2*a*) and being arranged at an opposite side of the connection unit (4*a*) relative to the receptacle (30).

Clause 30. The connection unit (4*a*) according to any preceding clause, wherein the connection unit (4*a*) comprises ground support members (33) which are configured for supporting the connection unit (4*a*) at a sea floor (13) with the receptacle (30) facing upwardly.

Clause 31. The connection unit (4*a*) according to any preceding clause, wherein the ground support members (33) comprise or define a passage or opening (34) at which the ground support members (33) do not engage the sea floor (13) when the connection unit (4*a*) is positioned at the sea floor (13), and through which an anchor line (2*a*) can extend.

Clause 32. The connection unit (4*a*) according to any preceding clause, wherein a largest width (W) of the connection unit (4*a*) is greater than a largest height (H) of the connection unit (4*a*).

Clause 33. The connection unit (4*a*) according to any preceding clause, wherein the connection unit (4*a*) comprises a signal transmitter, such as a hydroacoustic signal transmitter, which is operatively arranged to transmit a signal indicative of a location of the connection unit (4*a*) to a mobile offshore drilling unit (20).

Clause 34. An anchoring assembly (1*a-h*) comprising:

a connection unit (4*a*) according to any preceding clause; an anchor line (2*a*); and a sea floor anchor (3*a*) connected to or configured to be connected to the anchor line (2*a*) at a distal end thereof.

Clause 35. A set of anchoring equipment, the set comprising:

a connection unit (4*a*) according to any preceding clause; and a connection member (23) connected to or configured to be connected to a drilling unit anchor line (22).

Clause 36. The set according to any preceding clause, wherein, the connection unit (4*a*) comprises a signal transmitter or receiver, such as a hydroacoustic signal transmitter or receiver, the connection member (23) comprises a corresponding signal receiver or transmitter, such as a hydroacoustic signal receiver or transmitter, and the signal transmitter and receiver is operable to produce a signal which is indicative of a horizontal distance between the connection member (23) and the receptacle (30).

Clause 37. The set according to any preceding clause, wherein, the connection unit (4*a*) comprises a signal transmitter or receiver, such as a hydroacoustic signal transmitter or receiver, the connection member (23) comprises a corresponding signal receiver or transmitter, such as a hydroacoustic signal receiver or transmitter, and the signal transmitter and receiver is operable to produce a signal which is indicative of a vertical distance between the connection member (23) and the receptacle (30).

Clause 38. The set according to any preceding clause, comprising:

a release actuator arranged at the connection unit (4*a*) or at the connection member (23) and operable to release the connection unit (4*a*) from the connection member (23) in response to a signal, such as a hydroacoustic signal; and/or a tool interface arranged at the connection unit (4*a*) or at the connection member (23) for engagement by a remotely operated underwater vehicle (ROV) to release the connection unit (4*a*) from the connection member (23).

The present invention is not limited by the embodiments described above; reference should also be had to the appended claims.

LIST OF REFERENCE CHARACTERS

1*a-h* Anchoring assemblies
2*a* Anchor line
3*a* Sea floor anchor
4*a* Connection unit
11 Drilling site
13 Sea floor
14 Sea surface
19 Satellite
20 Mobile offshore drilling unit (MODU)
21 Installation vessel
22 Drilling unit anchor line
23 Connection member
25 Remote operated underwater vehicle (ROV)
26 Cable
27 Anchor line support
30 Receptacle
31 Anchor line connector
33 Ground support members
34 Opening
H Largest height
W Largest width

What is claimed is:

1. A method of temporarily anchoring a mobile offshore drilling unit at an offshore drilling site, the method comprising:

laying out a plurality of anchoring assemblies at a sea floor, each anchoring assembly of the plurality of anchoring assemblies comprising a connection unit which is laid out adjacent to the offshore drilling site, an anchor line which extends away from the offshore drilling site, and a sea floor anchor which is connected to the anchor line at a distal end thereof;

bringing the mobile offshore drilling unit to the offshore drilling site;

successively for each respective connection unit, operating a dynamic positioning system at the mobile offshore drilling unit to move the mobile offshore drilling unit to a position substantially vertically above the respective connection unit, lowering, from the mobile offshore drilling unit, a drilling unit anchor line comprising a connection member so as to engage the respective connection unit, and connecting the drilling unit anchor line with the respective anchoring assembly via the connection unit and the connection member; and tensioning up each drilling unit anchor line from the mobile offshore drilling unit so as to anchor the mobile offshore drilling unit at the offshore drilling site via the plurality of anchoring assemblies.

2. The method as recited in claim 1, wherein the step of connecting the drilling unit anchor line with the respective anchoring assembly and the step of tensioning up each drilling unit anchor line are performed without an involvement of an anchor installation vessel.

3. The method as recited in claim 1, further comprising:

reeling out each drilling unit anchor line from the mobile offshore drilling unit;

disconnecting each respective connection unit from the connection member which had been connected thereto; and removing the mobile offshore drilling unit from the offshore drilling site.

4. The method as recited in claim 3, further comprising:

removing the plurality of anchoring assemblies from the sea floor via an anchor installation vessel after the mobile offshore drilling unit has been removed from the offshore drilling site.

5. The method as recited in claim 1, wherein, each respective connection unit comprises a receptacle which is operable to receive the connection member, and the step of lowering the drilling unit anchor line comprises lowering the connection member into the receptacle.

6. The method as recited in claim 5, further comprising:

identifying a horizontal distance between the connection member and the receptacle; and operating the dynamic positioning system at the mobile offshore drilling unit to move the mobile offshore drilling unit a horizontal distance which corresponds to the horizontal distance between the connection member and the receptacle so as to position the connection member vertically above the receptacle.

7. The method as recited in claim 5, wherein, each connection unit comprises a signal transmitter or receiver and each connection member comprises a corresponding signal receiver or transmitter, the signal transmitter and receiver being operable to produce a signal which is indicative of a horizontal distance between the connection member and the receptacle, and the method further comprises:

receiving the signal at the mobile offshore drilling unit; and operating the dynamic positioning system at the mobile offshore drilling unit to move the mobile offshore drilling unit a horizontal distance in response to the signal so as to position the connection member vertically above the receptacle.

8. The method as recited in claim 1, wherein, the step of laying out the plurality of anchoring assemblies at the sea floor further comprises logging a location of each respective connection unit at the sea floor, and the step of operating the dynamic positioning system at the mobile offshore drilling unit to move the mobile offshore drilling unit to the position substantially vertically above the respective connection unit comprises using the logged location of the respective connection unit to control the dynamic positioning system.

9. The method as recited in claim 1, wherein, each respective connection unit comprises a signal transmitter, and the method further comprises:

receiving a signal from the signal transmitter;

determining a horizontal distance between the mobile offshore drilling unit and the respective connection unit; and operating the dynamic positioning system at the mobile offshore drilling unit to move the mobile offshore drilling unit towards the respective connection unit a distance which corresponds to the horizontal distance which was determined between mobile offshore drilling unit and the respective connection unit.

10. The method as recited in claim 1, wherein, the mobile offshore drilling unit comprises a plurality of anchor line supports which are positioned at different locations of the mobile offshore drilling unit, each drilling unit anchor line being associated with one of the plurality of anchor line supports, and the step of operating the dynamic positioning system at the mobile offshore drilling unit to move the mobile offshore drilling unit to the position substantially vertically above the respective connection unit comprises moving the mobile offshore drilling unit to a position at which a respective anchor line support is substantially vertically above the respective connection unit.

11. A connection unit which is configured to be laid on a sea floor adjacent to a drilling site as a part of an anchoring assembly, the connection unit comprising:

a receptacle which is configured to receive a connection member;

a locking mechanism which is configured to lock the connection member in place in the receptacle; and a signal transmitter which is operatively arranged to transmit a signal indicative of a location of the connection unit to a mobile offshore drilling unit.

12. The connection unit as recited in claim 11, further comprising:

an anchor line connector which is configured to connect to an anchor line, the anchor line connector being arranged at an opposite side of the connection unit relative to the receptacle.

13. The connection unit as recited in claim 12, further comprising:

ground support members each of which are configured to support the connection unit at the sea floor with the receptacle facing upwardly.

14. The connection unit as recited in claim 13, wherein the ground support members comprise or define a passage or opening at which the ground support members do not engage the sea floor when the connection unit is positioned on the sea floor, the passage or opening being configured so that an anchor line can extend therethrough.

15. The connection unit as recited in claim 11, wherein a largest width of the connection unit is greater than a largest height of the connection unit.

16. A set of anchoring equipment comprising:

a connection member which is connected to or configured to be connected to a drilling unit anchor line;

a connection unit comprising:

a receptacle which is configured to receive the connection member, and a locking mechanism which is configured to lock the connection member in place in the receptacle; and a release actuator which is arranged at the connection unit or at the connection member, the release actuator being operable to release the connection unit from the connection member in response to a signal.

17. The set of anchoring equipment as recited in claim 16, wherein the connection unit further comprises a signal transmitter or receiver and the connection member comprises a corresponding signal receiver or transmitter, the signal transmitter and receiver being operable to produce a signal indicative of a horizontal and/or vertical distance between the connection member and the receptacle.

18. The set of anchoring equipment as recited in claim 16, further comprising:

a tool interface which is arranged at the connection unit or at the connection member, the tool interface being configured to engage with a remotely operated underwater vehicle so as to release the connection unit from the connection member.

* * * * *